US012319532B2

(12) United States Patent
Dekervel et al.

(10) Patent No.: US 12,319,532 B2
(45) Date of Patent: Jun. 3, 2025

(54) SHEET PROCESSING MACHINE

(71) Applicant: BOBST MEX SA, Mex (CH)

(72) Inventors: Arnaud Dekervel, Thonon-les-bains (FR); Patrice Chatry, Lugrin (FR)

(73) Assignee: BOBST MEX SA, Mex (CH)

( * ) Notice: Subject to any disclaimer, the term of this patent is extended or adjusted under 35 U.S.C. 154(b) by 225 days.

(21) Appl. No.: 18/257,199

(22) PCT Filed: Dec. 16, 2021

(86) PCT No.: PCT/EP2021/086234
§ 371 (c)(1),
(2) Date: Jun. 13, 2023

(87) PCT Pub. No.: WO2022/129353
PCT Pub. Date: Jun. 23, 2022

(65) Prior Publication Data

US 2024/0043236 A1 Feb. 8, 2024

(30) Foreign Application Priority Data

Dec. 17, 2020 (EP) ..... 20215108

(51) Int. Cl.
*B65H 43/06* (2006.01)
*B65H 43/08* (2006.01)

(52) U.S. Cl.
CPC ..... *B65H 43/08* (2013.01); *B65H 43/06* (2013.01); *B65H 2511/15* (2013.01);
(Continued)

(58) Field of Classification Search
CPC ..... B65H 29/04; B65H 31/10; B65H 43/06; B65H 43/08; B65H 2553/412;
(Continued)

(56) References Cited

U.S. PATENT DOCUMENTS 7,841,589 B2 * 11/2010 Kawata ..... B65H 9/101 270/58.11
8,613,446 B2 * 12/2013 Miyake ..... G03G 15/6552 271/298

(Continued)

FOREIGN PATENT DOCUMENTS

CN 102009862 A 4/2011
DE 20103326 U1 5/2001

(Continued)

*Primary Examiner* — Leslie A Nicholson, III
(74) *Attorney, Agent, or Firm* — Bookoff McAndrews, PLLC

(57) ABSTRACT

A sheet processing machine comprises a receiving area (38) for collecting a sheet pile and a device (36) for determining the height of the sheet pile. The device (36) comprises a manually displaceable first sensor element arranged at a first side (48) of the receiving area (38), and an automatically displaceable second sensor element (50) arranged at an opposite side (52) of the receiving area (38) such that the first and second sensor elements (50) are arranged opposite each other along a width direction of the receiving area (38). The first sensor element and the second sensor element (50) are displaceable along a length direction of the sheet receiving area (38), wherein the first sensor element is one of a light emitting source and a light receiving sensor (56) and the second sensor element (50) is the other one of a light emitting source and a light receiving sensor (56). The light emitting source and the light receiving sensor (56) form a light barrier (58) along the width direction when facing each other.

9 Claims, 2 Drawing Sheets

Figure 1:
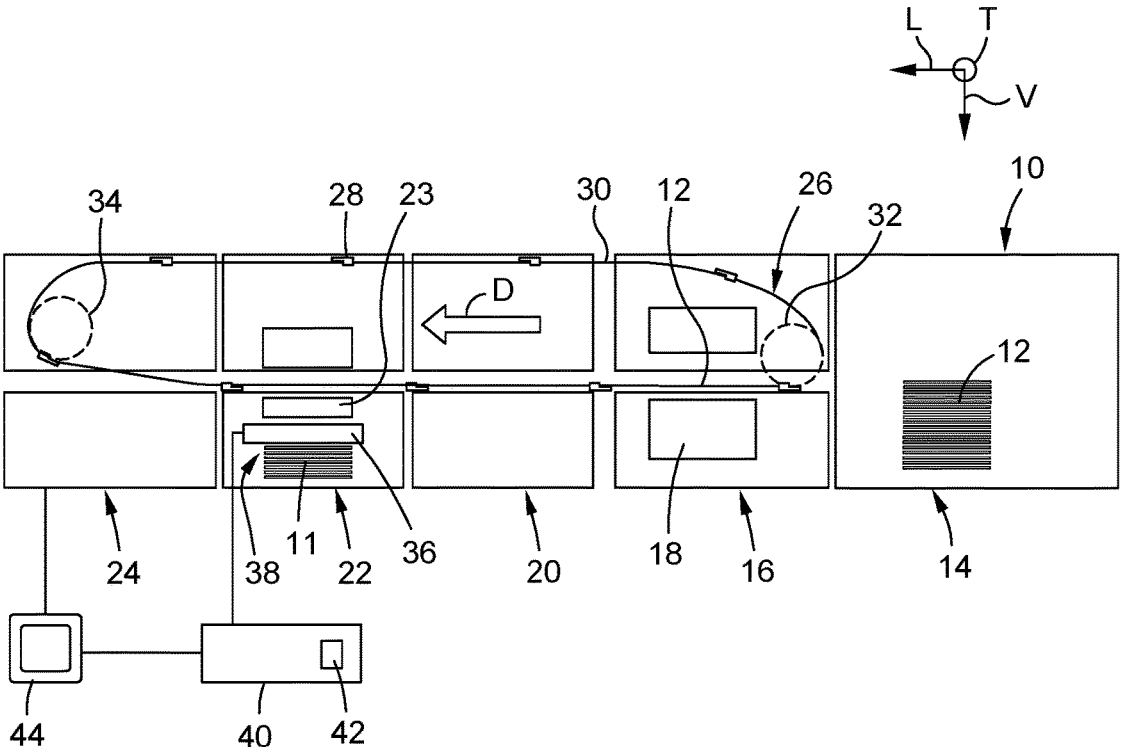

(52) U.S. Cl.
CPC .... *B65H 2511/20* (2013.01); *B65H 2553/412* (2013.01); *B65H 2553/81* (2013.01); *B65H 2801/42* (2013.01)

(58) Field of Classification Search
CPC ..... B65H 2553/416; B65H 2511/10; B65H 2511/152; B65H 2220/01; B65H 2801/21; B65H 2801/31; B65H 2801/42
USPC ..... 270/52.06, 58.02
See application file for complete search history.

(56) References Cited

U.S. PATENT DOCUMENTS

| | | | | |
|---|---|---|---|---|
| 9,834,399 | B1 * | 12/2017 | Hashimoto | B65H 9/002 |
| 2005/0077672 | A1 | 4/2005 | Gombau et al. | |
| 2020/0255241 | A1 * | 8/2020 | Hirahara | B65H 9/166 |

FOREIGN PATENT DOCUMENTS

| | | | |
|---|---|---|---|
| JP | 2000143070 | A | 5/2000 |
| JP | 2002012365 | A | 1/2002 |
| JP | 2004284790 | A | 10/2004 |
| JP | 2009120319 | A | 6/2009 |
| JP | 2011068425 | A | 4/2011 |
| JP | 2017145071 | A | 8/2017 |
| TW | 200520941 | A | 7/2005 |

* cited by examiner

SHEET PROCESSING MACHINE

CROSS-REFERENCE TO RELATED APPLICATION(S)

This application is a National Stage Application under 35 U.S.C. § 371 of International Application No. PCT/EP2021/086234, filed on Dec. 16, 2021, which claims priority to European Application No. 20215108.0, filed on Dec. 17, 2020, the entireties of which are incorporated herein by reference.

The invention relates to a sheet processing machine comprising a device for determining the height of a sheet pile.

Sheet processing machines, also known as converting machines, are used in the packaging industry for processing raw materials, e.g. cardboard, paper or foils, into intermediate or finished products, typically in the form of sheets. Converting operations can e.g. include printing, cutting, creasing, blanking, stamping and/or folding-gluing. Typically, the individual operations are done in subsequent processing stations of the sheet processing machine with the sheets being conveyed from one processing station to the subsequent one by a transfer mechanism.

The processed sheets can be collected in a sheet pile, i.e. in a vertical stack of sheets, after processing in a designated receiving area of the sheet processing machine. It is desirable to collect a defined batch size of processed sheets in the receiving area to simplify subsequent handling and/or logistic steps.

As the sheets have a defined thickness, the batch size corresponds to the height of the sheet pile. To measure the height of sheet piles, sheet processing machines as known in the art can comprise a light barrier arranged at a predetermined height of the receiving area.

However, the size and shape of the processed sheets, e.g. of blanks pushed out of the sheets, vary between different sheet processing jobs. Therefore, the position of the components of the light barrier, i.e. of a light emitting element and of a light receiving element, must be carefully adjusted by a skilled operator of the sheet processing machine. This adjustment process is time-consuming and typically necessitates many complex handling operations, e.g. opening the corresponding processing station of the sheet processing machine, handling safety mechanisms for the operator, removing tools used in the processing stations etc.

More complicated detection systems which would not need any additional adjustment for different sheet processing jobs, e.g. a light curtain comprising a multitude of light barriers and monitoring the complete receiving area, are too expensive for most applications.

The object of the invention is to provide a simple and cheap means for measuring a height of a sheet pile, especially a means suited to measuring the height of the sheet pile for sheets of differing shape and/or size.

US 2005/0077672 discloses a system to control the height of a sheet pile using a light beam. The system is used in a drawer containing binder sheet (that help containing a pile of blanks). The light beam position being fixed, and the pile is lifted up until it cuts the beam. DE 20103326U uses a similar system applied to the pile of sheets at the input of a printer.

The object of the invention is solved by a sheet processing machine comprising a receiving area for collecting a sheet pile and a device for determining the height of the sheet pile. The device comprises a manually displaceable first sensor element arranged at a first side of the receiving area, and an automatically displaceable second sensor element arranged at an opposite side of the receiving area such that the first and second sensor elements are arranged opposite each other along a width direction of the receiving area. The first sensor element and the second sensor element are displaceable along a length direction of the sheet receiving area, wherein the first sensor element is one of a light emitting source and a light receiving sensor and the second sensor element is the other one of a light emitting source and a light receiving sensor. The light emitting source and the light receiving sensor form a light barrier along the width direction when facing each other.

The invention is based on the idea to combine a first sensor element manually handled by the operator with a second sensor element which is adapted to automatically adapt its position relative to the first sensor element, i.e. the position of the second sensor element does not need to be manually adjusted by the operator, too. This eliminates the need of carefully adjusting the first and second sensor element manually by the operator and allows less well-trained personnel to operate the sheet processing machine.

Further, the sheet processing machine according to the invention does not require complex handling operations for setting up the device for determining the height of the sheet pile. Therefore, downtimes of the sheet processing machine between different sheet processing jobs can be reduced.

At the same time, by keeping a manually adjustable sensor element, the operator can adapt the position of the light barrier to be suitable for the size and/or shape of the sheets obtained in the receiving area for the sheet processing job at hand.

Further, the device for determining the height of the sheet pile is simple and cheap, as a single light barrier is sufficient for reliably determining if the sheet pile has reached the height at which the light barrier is present.

To keep the device for determining the height of the sheet pile as cheap and simple as possible, preferably only one light emitting element and only one light receiving sensor is used.

The width direction and the length direction are especially perpendicular to each other.

The first sensor element and the second sensor element can be mounted on a first rail and a second rail, respectively. The first rail and the second rail are especially parallel to each other.

To simplify the construction of the device for determining the height of the sheet pile, the first rail and the second rail can be linear rails.

In one variant, the first sensor element is mounted by a slotted guide slider in a slotted guide of the first rail. The slotted guide slider especially extends out of the slotted guide such to be manageable by the operator of the sheet processing machine. Accordingly, the position of the first sensor element can be adjusted by the operator by moving the slotted guide slider in the slotted guide to the desired position.

The second sensor element can be displaceable by means of a motor of the second sensor element, especially an actuator of the second sensor element. The motor can be connected to the second rail and enables the device for measuring the height of the sheet pile to adjust the position of the second sensor element in an automated manner.

Preferably, the device comprises a control unit connected to the first sensor element and to the second sensor element, the control unit being adapted to receive a sensor signal from the light receiving sensor and to control the movement of the second sensor element. Accordingly, the control unit is responsible for ensuring that the first and second sensor element face each other so that the light barrier is formed.

The control unit is especially adapted to move the second sensor element along the length direction to a working position, wherein in the working position the sensor signal is non-zero. Preferably, the sensor signal is maximum when the second sensor element is in the working position.

A "non-zero" sensor signal here and in the following means that the sensor signal is above the noise level of the corresponding light receiving sensor.

As long as the first and second sensor elements, and therefore the light emitting source and the light receiving sensor, are not facing each other, the light barrier cannot be successfully formed, i.e. the light emitted by the light emitting source cannot reach the light receiving sensor. When the alignment is optimal, the sensor signal is expected to be maximum. This allows the control unit to use the sensor signal received from the light receiving sensor as control variable when searching for the correct position of the second sensor element, i.e. for the working position of the second sensor element.

For this purpose, the control unit can be adapted to move the second sensor element along the whole length of the second rail and afterwards move the second sensor element to the position associated to the maximum sensor signal.

Alternatively, the control unit can be adapted to stop the movement of the second sensor element along the second rail as soon as the sensor signal decreases by a pre-determined first threshold value after increasing by a pre-determined second threshold and to move the second sensor element back to the position before the sensor signal started to decrease. With other words, the control unit can be adapted to stop the movement of the second sensor signal after the first time a maximum of the sensor signal has been identified. As preferably only a single light emitting source is used, there is no need to continue measuring the sensor signal for all further positions of the second sensor element along the second rail.

The first and second threshold need to be chosen such that random fluctuations in the sensor signal, e.g. due to noise, are not erroneously indicating a maximum value of the sensor signal. E.g., the first and second threshold can be determined as a multiple of the noise level of the light receiving sensor, e.g. ten times the noise level. Of course, the first and second threshold can have the same or different values.

Further, the control unit can be adapted to move the second sensor element to the working position each time the first sensor element has been moved. In this way, it can be ensured that each time after the operator manually re-adjusts the position of the first sensor element to be in line with a new sheet processing job, the second sensor element automatically becomes aligned to form the light barrier.

In addition, the control unit can be configured to only move the second sensor element to the working position after the first sensor element has been moved a distance corresponding to a displacement threshold. This ensures that the control unit does not re-adjust the position of the second sensor element after minimal movements of the first sensor element, e.g. due to vibrations of the sheet processing machine.

Additionally, the control unit can be adapted to move the second sensor element only when the sheet processing machine is in a set-up mode.

The set-up mode can be started and ended by the operator by means of a human-machine-interface. The human-machine-interface especially can be used for controlling the sheet processing machine and to display information about the current state of the sheet processing machine.

Preferably, the first sensor element is arranged at an operator side of the sheet processing machine and the second sensor element is arranged at an opposite operator side of the sheet processing machine. Accordingly, the operator of the sheet processing machine can easily access the first sensor element which needs to be handled manually while the second sensor element, which is laborious and time-consuming for the operator to access, can be handled automatically.

The receiving area can be part of a blank separation station of the sheet processing machine and the sheet pile can be a pile of blanks. Blanks produced by processing sheets can have a wide variety of sizes and/or shapes such that it is especially advantageous to use the device for determining the height of the sheet pile which is adjustable to the blanks produced in the present sheet processing job.

Figure 2:
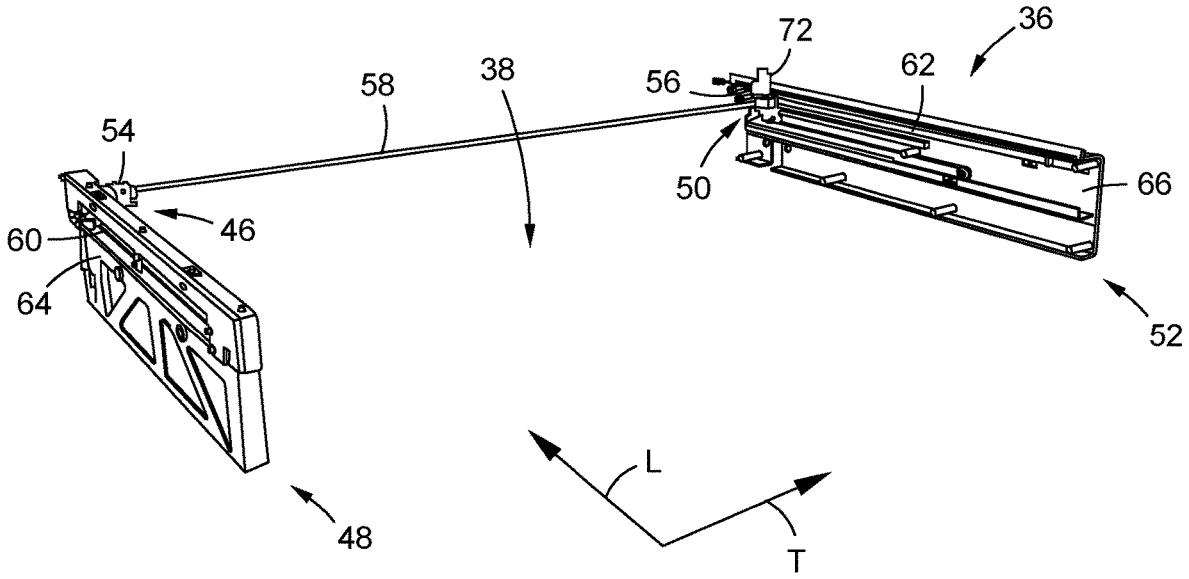
Figure 3:
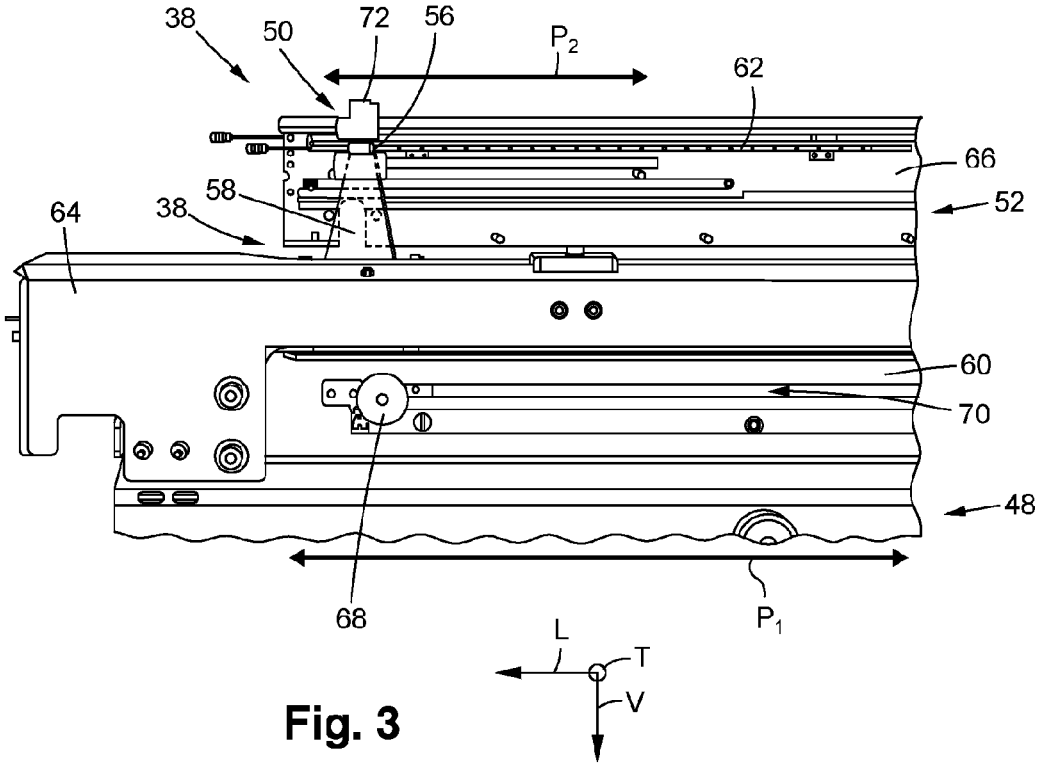

Further advantages and features will become apparent from the following description of the invention and from the appended figures which show a non-limiting exemplary embodiment of the invention and in which:

FIG. 1 schematically shows a sheet processing machine according to the invention;

FIG. 2 shows a perspective view of a device for determining the height of a sheet pile of the sheet processing machine of FIG. 1; and FIG. 3 shows a partial side view of the device of FIG. 2.

FIG. 1 schematically shows a sheet processing machine 10 making it possible to cut blanks 11 from a succession of sheets 12. These blanks 11 are usually intended to be subsequently folded and bonded to form packaging boxes.

However, the sheets 12 might generally be made of e.g. paper, cardboard, foil, a composite material thereof or any other material routinely used in the packaging industry.

The sheet processing machine 10 comprises a series of processing stations that are juxtaposed but interdependent one another in order to form a unitary assembly. The processing machine 10 includes a loading station 14 followed by a cutting station 16 (also usually named punching station) comprising for example a die or platen press 18 where the sheets 12 are transformed by cutting, a waste removal station 20 wherein most of the waste parts are stripped, a blank separation station 22 (also usually named reception station) for separation of the blanks 11 (or blanking operation) by means of a blanking tool 23 and an evacuation station 24 for removing the residual waste sheets of the punched sheets 12.

The number and nature of the processing stations may vary depending on the nature and the complexity of the converting operations to be carried out on the sheets 12.

The sheet processing machine 10 also has a transfer mechanism 26, which in the shown embodiment is a conveyor, to make it possible to individually move each sheet 12 from an outlet of the loading station 14 to the evacuation station 24.

The conveyor uses a series of gripper bars 28 that are mounted so as to be moveable by means of two loops of chains 30 one placed laterally on each side of the sheet processing machine 10. Each loop of chains 30 travels around a loop which allows the gripper bars 28 to follow a trajectory passing successively by the cutting station 16, the waste removal station 20, the blank separation station 22 and the evacuation station 24.

Each gripper bar 28 travels on an outward path in a substantially horizontal plane of passage between a driven wheel 32 and an idler wheel 34, and then a return path in the top portion of the sheet processing machine 10. Once returned to the driven wheel 32, each gripper bar 28 is then able to grip a new sheet 12 at a front edge of the sheet 12.

In FIG. 1, each processing station is illustrated in the form of two rectangles symbolizing respectively its top portion and its bottom portion that are positioned on each side of the plane of movement of the sheets 12.

In FIG. 1, a transverse (or lateral), longitudinal and vertical direction are indicated by the orthogonal spatial system (T, L, V).

The terms "upstream" and "downstream" are defined with reference to the direction of movement of sheets 12 in a handling direction as illustrated by the arrow D in FIG. 1.

The sheet processing machine 10 further comprises a device 36 for determining the height of a sheet pile in a receiving area 38 of the blank separation station 22. Accordingly, the sheet pile is a pile of blanks 11 in the shown embodiment.

The device 36 is connected to a control unit 40, e.g. by an Ethernet connection, the control unit 40 being adapted for controlling the device 36. However, the device 36 could also be connected to the control unit 40 by any means which provides a sufficiently fast exchange of signals between the device 36 and the control unit 40. E.g., the connection can also be established wireless, e.g. by Wi-Fi. The control unit 40 further comprises a storage module 42.

The sheet processing machine 10 further comprises a human-machine-interface 44 which in the shown embodiment is a touch-sensitive display.

By the human-machine-interface 44, a (not shown) operator can control the operation of the sheet processing machine 10. Further, information about the current status of the sheet processing machine 10 can be displayed on the human-machine-interface 44 to inform the operator.

In FIG. 2, a perspective view of the device 36 is shown.

The device 36 comprises a first sensor element 46 arranged at a first side 48 of the receiving area 38 and a second sensor element 50 arranged at an opposite side 52 of the receiving area 38 such that the first sensor element 46 and the second sensor element 50 are opposite each other along a width direction of the receiving area 38 which in the shown embodiment corresponds to the transverse direction T (see FIG. 1).

The first sensor element 46 comprises a light emitting source 54 and the second sensor element 50 comprises a light receiving sensor 56.

In principle, the light emitting source 54 and the light receiving sensor 56 could also be swapped, i.e. the first sensor element 46 could also comprise the light receiving sensor 56 and the second sensor element 50 could comprise the light emitting source 54.

When the light emitting source 54 and the light receiving sensor 56 are facing each other as shown in FIG. 2, a light barrier 58 is formed between the light emitting source 54 and the light receiving sensor 56. Accordingly, any interruption of the light barrier 58 can be registered based on the sensor signal of the light receiving sensor 56.

The first sensor element 46 is mounted to a first rail 60 and the second sensor element 50 is mounted to a second rail 62, wherein the first rail 60 and the second rail 62 are parallel to each other and to a length direction of the receiving area 38 which is perpendicular to the width direction of the receiving area 38 and which in the shown embodiment corresponds to the longitudinal direction L.

The first rail 60 and the second rail 62 are mounted to a first frame 64 and a second frame 66, respectively. The first frame 64 and the second frame 66 are connected to the blank separation station 22. Accordingly, the device 36 is suited to be retrofittable to existing sheet processing machines 10.

In principle, the first frame 64 and the second frame 66 could also be parts of the blanking separation station 22 instead of being parts of the device 36.

FIG. 3 shows a side view of selected parts of the device 36 of FIG. 2.

From FIG. 3 it becomes apparent that the first sensor element 46 is mounted by a slotted guide slider 68 in a slotted guide 70 of the first rail 60. Accordingly, the first sensor element 46, and therefore the light emitting source 54 (see FIG. 2) are displaceable along the length direction of the receiving area 38 as indicated by the double-arrow $P_1$ shown in FIG. 3.

More specifically, the first sensor element 46 is manually displaceable along the length direction of the receiving area 38 by the operator, i.e. the first side 48 of the receiving area 38 is arranged at an operator side of the sheet processing machine 10 which can be easily accessed by the operator.

The second sensor element 50 comprises an actuator 72, rendering the second sensor element 50 automatically displaceable along the length direction of the receiving area 38 as indicated by the double-arrow $P_2$ in FIG. 3.

The opposite side 52 of the receiving area 38 is arranged at an opposite operator side of the sheet processing machine 10 which cannot be easily accessed by the operator.

In the following, the mode of action of the sheet processing machine 10 in regard to the device 36 will be discussed in more detail.

For preparing the sheet processing machine 10 for a sheet processing job, the operator sets the sheet processing machine in a set-up mode via the human-machine-interface 44. This change in operation mode is registered by the control unit 40. In principle, the device 36 could also be used analogously without entering a specific set-up mode.

Next, the operator manually displaces the first sensor element 46 along the length direction of the receiving area 38 by shifting the slotted guide slider 68 along the slotted guide 70 to a target position.

The target position is chosen such that, during operation of the sheet processing machine 10, when blanks 11 are collected in a pile of blanks 11 in the receiving area 38 up to a target height, at least a part of the uppermost blank 11 of the pile of blanks 11 is at the same position along the length direction of the receiving area 38 as the light emitting source 54 of the first sensor element 46.

With other words, if the blanks 11 in the pile of blanks 11 do not extend over essentially the complete length direction of the receiving area 38, the first sensor element 46 is placed by the operator at a position in which the blanks 11 will be present.

The control unit 40, which is connected to the first sensor element 46 and to the second sensor element 50, registers that the first sensor element 46 has been moved and starts to automatically displace the second sensor element 50 along the second rail 62 by controlling the actuator 72 for finding a working position of the second sensor element 50.

To determine the working position, the light receiving sensor 56 transmits its sensor signal at every position along the second rail 62 to which the second sensor element 50 has been moved by the control unit 40.

The control unit 40 stores the received sensor signals together with the associated position along the second rail 62 in the storage module 42.

When the light emitting source 54 and the light receiving sensor 56 are facing each other, the light barrier 58 is formed (see FIG. 2), resulting in a non-zero sensor signal from the light receiving sensor 56. The better the alignment of the light emitting source 54 and the light receiving sensor 56, the higher the resulting sensor signal will be, i.e. the maximum sensor signal is indicative for the best alignment between the light emitting source 54 and the light receiving sensor 56.

Therefore, the working position is determined by the control unit 40 by identifying the position of the second sensor element 50 along the second rail 62 at which the received associated sensor signal has been maximum. Therefore, the second sensor element 50 is moved to this position along the second rail 62.

Afterwards, the control unit 40 transmits a message to the human-machine-interface 44 to inform the operator that the device 36 has been properly set up and the light barrier 58 has been successfully formed.

Therefore, the operator can change the sheet processing machine 10 from the set-up mode to an operation mode in which the sheets 12 are processed to form blanks 11 which stack to a pile of blanks 11 in the receiving area 38.

During the operation of the sheet processing machine 10, the first and second sensor elements (46, 50) work in an intermittent fashion: when the sheet processing machine ejects a blank, the sensor elements are temporarily disabled for the time the blank needs to cross the light barrier. The remaining time, the light receiving sensor 56 is receiving constantly or at least once per pre-determined time unit, for example once per 50 ms, transmits the current sensor signal to the control unit 40. Advantageously, the light receiving sensor comprises several sensor cells disposed one above the other to precisely determine the height of the uppermost blank 11.

As soon as the pile of blanks 11 reaches a height at which the uppermost blank 11 is at the same height as the light barrier 58, the light barrier 58 will become interrupted and the sensor signal of the light receiving sensor 56 will drop, especially drop to a value of zero or at least to a value corresponding to the noise level of the light receiving sensor 56.

This change of the sensor signal is registered by the control unit 40. The control unit 40 is adapted to transmit a message to the human-machine-interface 44 that the height of the pile of blanks 11 has reached the height of the light barrier of the device 36.

Preferably, this height corresponds to a target number of blanks 11 such that the operator can stop the operation of the sheet processing machine 10 and remove the produced blanks 11 from the blank separation station 22.

In principle, the control unit 40 can also be adapted to automatically stop the operation of the sheet processing machine, once the light barrier 58 becomes interrupted.

For the next sheet processing job, the operator can again enter the set-up mode and manually adjust the position of the first sensor element 46, if necessary, and repeat the above described process.

In the embodiment described above, the device 36 for determining the height of the sheet piles is used to detect when a pile of sheets 12, more specifically a pile of blanks 11, is piled up which essentially corresponds to determine at which point in time during operation of the sheet processing machine 10 a certain number of blanks 11 have been produced.

However, the device 36 could also be used analogously to detect when a pile of sheet 12 becomes torn down, i.e. to detect when so many sheets 12 have been removed from the pile of sheets 12 that the height of the sheet pile is lower than the height of the light barrier 58.

The sheet processing machine according to the invention provides an especially simple to operate and cheap possibility for checking the height of a sheet pile. Further, the operation of the sheet processing machine can be easily adjusted to a wide variety of sizes and/or shapes of the sheets.

The invention claimed is:

1. A sheet processing machine comprising:

a receiving area for collecting a sheet pile; and a device for determining a height of the sheet pile, the device comprising a manually displaceable first sensor element arranged at a first side of the receiving area, and an automatically displaceable second sensor element arranged at an opposite side of the receiving area such that the first and second sensor elements are arranged opposite each other along a width direction of the receiving area, and the first sensor element and the second sensor element being displaceable along a length direction of the sheet receiving area, wherein the first sensor element is one of a light emitting source and a light receiving sensor and the second sensor element is the other one of the light emitting source and the light receiving sensor, the light emitting source and the light receiving sensor forming a light barrier along the width direction when facing each other.

2. The sheet processing machine according to claim 1, wherein the first sensor element and the second sensor element are mounted on a first rail and a second rail, respectively.

3. The sheet processing machine according to claim 2, wherein the first sensor element is mounted by a slotted guide slider in a slotted guide of the first rail.

4. The sheet processing machine according to claim 1, the second sensor element being displaceable by means of a motor of the second sensor element, especially an actuator of the second sensor element.

5. The sheet processing machine according to claim 1, the device comprising a control unit connected to the first sensor element and to the second sensor element, the control unit being adapted to receive a sensor signal from the light receiving sensor and to control a movement of the second sensor element.

6. The sheet processing machine according to claim 5, the control unit being adapted to move the second sensor element along the length direction to a working position, wherein in the working position the sensor signal is non-zero, preferably wherein in the working position the sensor signal is maximum.

7. The sheet processing machine according to claim 6, the control unit being adapted to move the second sensor element to the working position each time the first sensor element has been moved.

8. The sheet processing machine according to claim 1, wherein the first sensor element is arranged at an operator side of the sheet processing machine and the second sensor element is arranged at an opposite operator side of the sheet processing machine.

9. The sheet processing machine according to claim 1, wherein the receiving area is part of a blank separation station of the sheet processing machine and the sheet pile is a pile of blanks.

* * * * *